United States Patent [19]

Siegal

[11] 4,159,792

[45] Jul. 3, 1979

[54] SKI GLOVE LEASH

[76] Inventor: Sanford Siegal, 8045 NW. 36th St., Miami, Fla. 33166

[21] Appl. No.: 871,892

[22] Filed: Jan. 23, 1978

[51] Int. Cl.[2] ..... A44C 5/00

[52] U.S. Cl. ..... 224/267; 24/3 M

[58] Field of Search ..... 224/28 A, 28 G, 28 R, 224/28 B, 26 A, 26 R, 4 B, 4 C, 4 F, 4 G, 4 H, 5 R, 5 J, 55, 56, 57, 58; 24/3 J, 3 M, 3 R, 128 R, 73 A, 115 CH, 265 H, DIG. 29; 403/209; 294/74, 31.2

[56] References Cited

U.S. PATENT DOCUMENTS

| | | | |
|---|---|---|---|
| 452,830 | 5/1891 | Bowie et al. | 24/3 M |
| 754,241 | 3/1904 | Roll | 224/28 A |
| 879,591 | 2/1908 | Roussel | 24/128 R |
| 2,042,808 | 6/1936 | Seebeck | 24/3 M |
| 2,204,947 | 6/1940 | Apfelbaum | 224/28 A |

*Primary Examiner*—Robert J. Spar
*Assistant Examiner*—Kenneth W. Noland
*Attorney, Agent, or Firm*—Millen & White

[57] ABSTRACT

A tether or leash for gloves such as ski gloves, to maintain the glove attached to the wrist or wrist encircling garment, such as a parka sleeve, of the wearer when the glove is temporarily removed for some purpose; and generally including a length of elastic cord with eyeleted ends, one end passing through the eyelet at the opposite end to present a loop or band portion encircling the wrist area of the wearer and wherein the loop or band portion may be adjusted for approximate sizing by knotting the cord between the ends thereof.

7 Claims, 4 Drawing Figures

SKI GLOVE LEASH

BACKGROUND OF THE INVENTION

For attaching gloves, mittens and the like to outer garments, there have been various proposals such as elastic tapes or straps with safety pin or other attachment to the garment sleeve and glove; elongate straps or tapes with the ends attached to childrens' gloves or mittens and passed within each sleeve of the garment being worn and joined across the back; elastic tapes or straps for snugging a mitten or glove around the wrist of the wearer and attached to the sleeve of the outer garment being worn; and other comparable arrangements with slip buckles or the like for adjustment, all generally for the purpose of preventing loss of the gloves or mittens while permitting temporary removal and ready re-application thereof relative to the hands.

SUMMARY OF THE INVENTION

The present invention provides a length of an elastic and flexible cord as a tether or leash having terminal loops or eyelets, one to be threaded through the other to present a wrist area encircling band portion with the eyeleted or looped free end providing means for attachment of a glove to the wrist encircling band portion.

An object of the invention is to provide such a glove tether which may be readily applied about a wearer's wrist or the wrist encircling area of a garment sleeve and connected to a glove permitting temporary removal thereof as a hand covering with maintained attachment to the wrist or garment sleeve for ready re-application thereof as a hand covering.

Another object of the invention is to provide a glove tether substantially of the above type wherein the cord may be knotted prior to threading of the eyelets for adjustment of the band portion to approximate the desired size for a particular wearer and wherein the eyelets are relatively sized to facilitate threading of one through the other.

A further object of the invention is to provide such a glove tether wherein the knotting for adjustment will relatively position the eyelets in angular disposition to facilitate the threading of one eyelet through the other by easy hand manipulation.

The invention also aims to provide a glove tether substantially of the above type which is relatively inexpensive and which lends itself to simplified manufacturing techniques.

The above and other objects of the invention will in part be obvious and will be hereinafter more fully pointed out in the detail description having reference to the accompanying drawings in which, FIG. 1 is an elevation of the glove tether in initially manufactured condition;

Figure 1:
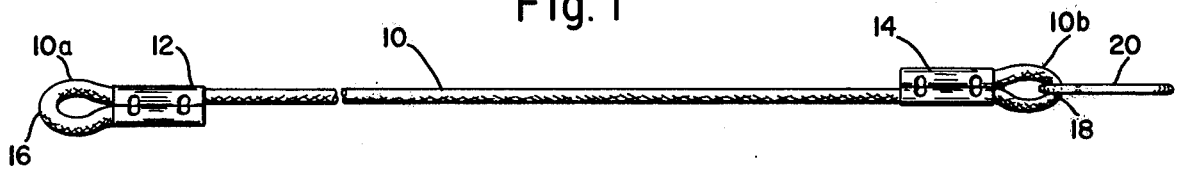

With reference to FIG. 1 of the accompanying drawing, the tether or leash includes a flexible strand or cord 10. This flexible cord may be elastic such as a nylon covered elastic cord of the so-called shock cord type, or in the interest of economy, it may be a cotton covered shock cord, or have some other covering. Opposite ends of the cord are looped as at 10*a*, 10*b*, with the adjacent lapped ends secured by press crimped clamps 12, 14, respectively, in the form of metal or similar sleeves with pressed indentations for securement. The looped ends provide eyelets 16, 18 of which one of the eyelets, as 16, is slightly longer than the other eyelet 18, to define an included opening which is slightly more elongate than the included opening within the eyelet 18. This relative differential sizing of the eyelets is to facilitate threading of the spring finger hook 20, carried by the eyelet 18, through the included opening within the eyelet 16, as well as threading of the eyelet 18, itself, through the opening of the eyelet 16 in forming a wrist or garment sleeve encircling band portion 24 of the cord between the eyelet 16 and the opposite end of the clamp 12, as shown in FIG. 3.

Figure 2:
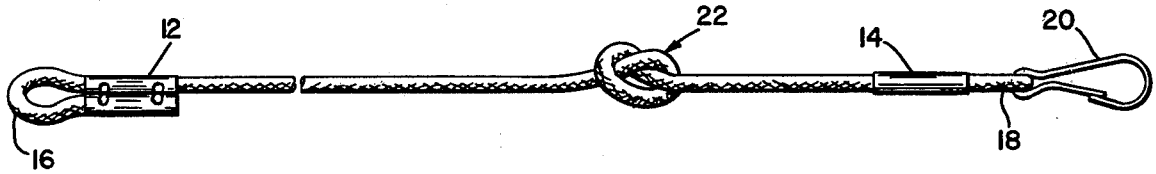
FIG. 2 is a view, similar to FIG. 1, showing the cord knotted for adjustment to a wearer.

Before forming the above band portion, the cord may be fitted around the wrist or wrist encircling garment sleeve of the user to determine a proper adjustment of the size of the band portion. Then a knot 22 is formed at appropriate location along the cord, as shown in FIG. 2, to realize the proper sizing of the band portion. Thereafter, the spring finger hook 20 is passed through the opening of the eyelet 16 and the eyelet 18 and clamp 14 are also threaded therethrough for the cord to assume the position of FIG. 3. In forming the knot 22, it will be noted that the clamp 14, the loop 10*b* and the finger hook 20 have been turned ninety degrees about the cord axis from the position of FIG. 1 to the position of FIG. 2. This will position the clamp 14 and the loop or eyelet 18 in flatwise orientation relative to the elongate larger included opening within the eyelet 16 to facilitate the widthwise extent of the eyelet 18 to be passed through the elongate opening of the eyelet 16 after passage of the hook 20 therethrough, the latter being easily twisted relative to the connected eyelet for this purpose.

Figure 3:
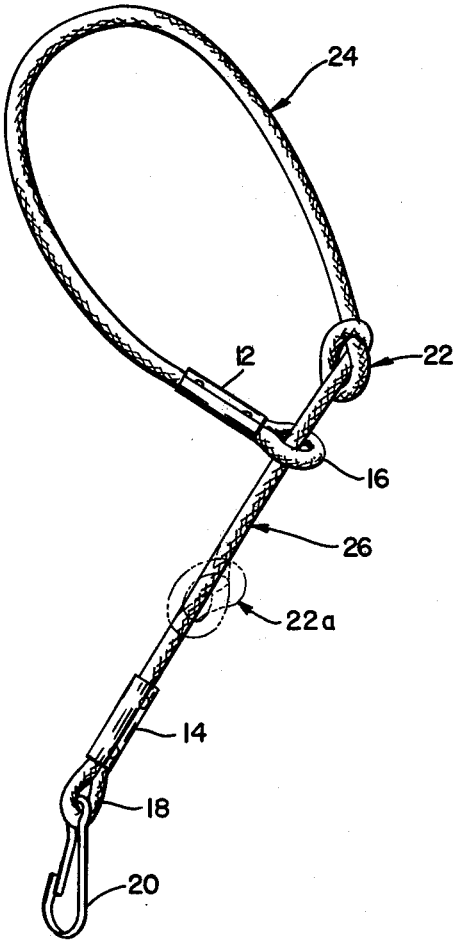
FIG. 3 is a perspective view showing the eyelets relatively threaded to present the knotted band portion for application to the wrist or wrist encircling sleeve portion of a user.
Figure 4:
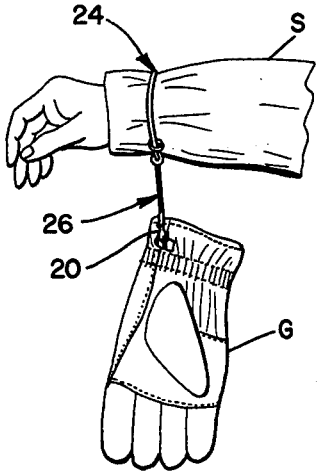
FIG. 4 is a perspective view showing the tether connected around a garment sleeve on a wearer with the glove attached thereto.

Having formed the band portion 24 to proper size, as in FIG. 3, this band portion may be slipped over the hand of the wearer by moving the eyelet 16 along the tether portion 26 of the cord toward the eyelet 18, or, if necessary, by slight elongate stretching of the cord, and then positioning the band portion about the wrist of the wearer or about the wrist encircling portion of the sleeve S of a garment, such as a parka. In drawing the hand portion into contracted position, the knot 22 will be engaged by the eyelet 16 and prevent the band portion from being pulled too tight initially, or if entangled, relying on stretching of the cord for release, if necessary. Practically all ski gloves are provided with spring finger hooks or attaching ring types of hardware. Thus, the spring finger hook 20 is attached to such hardware on a glove G, as shown in FIG. 4, to support the glove from the wrist area of a wearer when temporarily removed for one purpose or another, as shown in FIG. 4, from which tethered position, the glove can be readily re-applied to hand covering position while remaining tethered to the band portion 24 for further temporary removal as the need may arise. When the glove is in hand covering position, the tether portion 26 of the cord may be slightly taut to maintain the proximate positions of the eyelet 16 and the knot 22. The relative orientation of the eyelets 16, 18, as shown in FIG. 2, facilitate threading of the eyelet 18 and its associated parts through the eyelet 16 and this may be of particular advantage when the tether, before forming the band portion, is to be externally applied to the wrist or wrist encircling portion of the garment sleeve, as for example in fitting the tether to the wrist area of children. In such cases, the band portion 24 will be reduced in size and thus leave a more elongate cord tether portion 26 which, however, can be appropriately shortened in length by properly forming and locating an additional knot 22*a* along the tether portion between the eyelet 18 and the eyelet 16 which has been previously threaded, thus shortening the tether portion 26 for maintenance thereof in extended or somewhat taut condition when the glove is in hand covering position.

From the foregoing description, one skilled in the art can easily ascertain the essential characteristics of this invention, and without departing from the spririt and scope thereof, can make various changes and modifications of the invention to adapt it to various usages and conditions.

What is claimed is:

1. A glove tether for attaching a glove around the wrist area of a wearer; and comprising a single length of flexible cord between a formation at one end with the cord terminal portion looped and secured to itself to provide a free end eyelet formation and the opposite end threaded through the eyelet formation providing a loop or band portion to encircle the wrist area of a wearer and a tether portion extending therefrom; wherein said opposite end has means for attachment to a glove permitting the glove to be temporarily removed from hand covering position while maintained connected to the band portion which remains in encirclement with the wrist area of the wearer holding the glove in accessible position to be re-applied as a hand covering; wherein the cord terminal portion at each end of the cord is secured to itself within an adjacent eyelet formation by a clamp of predetermined transverse cross-section relative to the eyelet formation at said one end of the cord and wherein the eyelet formation at said one end is slightly larger than the eyelet formation at the opposite end whereby to facilitate threading of the latter and its associated clamp through the eyelet formation at said one end of the cord in forming the loop or band portion; and wherein the cord is knotted along the length thereof for size adjustment before threading of said opposite end through the eyelet formation at said one end of the cord with the said eyelet formation in proximate position relative said knot to prevent undue tightening of the band portion.

2. A glove tether as claimed in claim 1, wherein the said opposite end of the cord has the cord terminal portion looped and secured to itself to provide a free end eyelet formation means for attachment to cooperating hardware on a glove.

3. A glove tether as claimed in claim 2, wherein the eyelet formation at the said opposite end of the cord carries a spring finger hook for attachment to cooperating hardware on a glove.

4. A glove tether as claimed in claim 1, wherein the flexible cord is in the form of an elastic shock cord.

5. A glove tether as claimed in claim 1, wherein the flexible cord is in the form of an elastic shock cord resistant to axial twisting thereof tending to change predetermined relative orientations of the eyelet formations and the said opposite end of the cord has the eyelet formation initially in the same planar disposition as the eyelet at said one end of the cord, with the knot shifting the eyelet formation at said opposite end ninety degrees about the axis of the cord for orienting to a position facilitating threading thereof through the eyelet formation at said one end of the cord.

6. A glove tether as claimed in claim 5, wherein the tether portion is knotted to reduce the length thereof in compensation for reduced sizes of the band portion.

7. A glove tether as claimed in claim 5, wherein the eyelet formation at said opposite end of the cord carries a spring hook for attachment to cooperating hardware on a glove and sized to pass through the eyelet formation at said one end of the cord along with the adjacent clamp in forming the loop or band portion.

* * * * *